United States Patent [19]

Kjaer et al.

[11] 4,227,539

[45] Oct. 14, 1980

[54] TOBACCO MOISTENING METHOD AND APPARATUS

[75] Inventors: Ian Kjaer, Hadsund; Christoffer Schlünssen, Aalborg SV; Hans J. Møller, Harlev J; Niels E. Mortensen, Gistrup, all of Denmark

[73] Assignee: Skandinavisk Tobakskompagni A/S, Søborg, Denmark

[21] Appl. No.: 3,864

[22] Filed: Jan. 16, 1979

[30] Foreign Application Priority Data

Feb. 3, 1978 [DK] Denmark ..... 519/78

[51] Int. Cl.[3] ..... A24B 9/00

[52] U.S. Cl. ..... 131/138; 131/140 R

[58] Field of Search ..... 131/133, 136, 138, 140, 131/139

[56] References Cited

U.S. PATENT DOCUMENTS 2,152,965 4/1939 Kersey ..... 131/136

2,232,813 2/1941 Fouton ..... 131/140 R 2,704,080 3/1955 Young ..... 131/138

*Primary Examiner*—Stephen C. Pellegrino

*Attorney, Agent, or Firm*—Stevens, Davis, Miller & Mosher

[57] ABSTRACT

In order to moisten bunched tobacco leaves without disarranging the leaves, the bunch, possibly after having been exposed to warm steam, is suspended with the strapped neck portion pointing upwards. After inversion, the neck and adjacent portion of the bunch is immersed in a moistening liquid, and subsequently the bunch is re-inversed and subjected to an oscillatory shaking movement, thereby causing the tobacco leaves to rub against one another to promote the liquid penetration. After setting, the bunches are again subjected to shaking for loosening of the leaves which are fully cut free at the neck portion while maintained as an orderly stack of substantially smooth leaves ready for further processing.

17 Claims, 7 Drawing Figures

TOBACCO MOISTENING METHOD AND APPARATUS

BACKGROUND OF THE INVENTION

From the specification of Danish patent No. 128.976 a method and an apparatus are known for moisture conditioning of tobacco in bunches in such a way that the leaves will substantially maintain their position in the bunch so that, even after termination of the treatment, the leaves will form orderly bundles or stacks in which all of the leaves are properly oriented and are relatively smooth. Therefore, without being manipulated (by being turned and smoothed) the leaves may be passed to further processing in cutting and rolling machines for being used as wrappers and binders in cigars and similar tobacco articles. This is achieved in such a way that after the removal of the strapping at the butt end of the bunch, the tobacco leaves in each bunch are held together by being pinched in a region extending across the width of the bunch and having such a distance from the ends thereof that on both sides of said region the leaves may spread in order to make it possible for water applied to them by spraying, or air blown towards them, to penetrate between the leaves. In order to enhance this possibility, the leaves in each bunch may be held together successively in two different regions suitably spaced in the longitudinal direction of the bunch.

When moisture conditioning tobacco either according to this method or by traditionally dipping the bunches into water and subsequently flinging off the excessive water, the tobacco should be pretreated by placing the bunches in perforated boxes in which they are subjected to warm stream, that is preferably sucked through the box. By this pretreatment, a certain softening of the leaves in the bunch is assured so that the leaves can better stand the subsequent treatment and, furthermore, the originally very compact bunch will, to a certain degree, be loosened by separation of the individual leaves outside the strapped neck of the bunch. An additional important factor is that the leaves are heated by the steam, thus making it easier for the liquid subsequently applied to penetrate into the leaves through the wax coating on their surfaces.

No matter how the moistening is carried out, the tobacco must be given possibility for setting, i.e. for water absorbed into the leaves to distribute uniformly to all parts of the leaves. For this purpose, the moistened bunches may be stored, e.g. for approximately 24 hours, in a warm and damp atmosphere, whereupon the humidity of the leaves, if necessary, may be finally adjusted by applying additional liquid or by removing excessive moist, before the tobacco is delivered for further processing, or is stored in a cooling store with controlled temperature and humidity conditions.

Thus, all things considered, the moisture conditioning is quite a lengthy process which requires considerable manual handling of the tobacco and, in addition to this, requires considerable store capacity because of the time necessary for the setting.

SUMMARY OF THE INVENTION

An aim of the invention is to provide possibilities for reducing both the time and the costs involved by the process, while maintaining the considerable advantages of retaining the leaves substantially in the same shape and with the same relative position as in the original tobacco bunches.

More particularly, the invention primarily concerns a method for moisture conditioning of tobacco in substantially flat bunches, while maintaining the leaves in substantially the same shape and with the same relative position as in the untreated tobacco bunch. From the previously mentioned known method of the same kind, the method according to the invention differs in that while being held in a substantially vertical position with its strapped neck pointing downwardly, the bunch is partially immerged into moistening liquid and subsequently, after having been positioned with its neck pointing upwardly, is subjected to mechanical shaking in a first shaking section with limited possibility for the leaves held only at the neck portion of the bunch, the move relatively to each other, the bunch after setting being again subjected to shaking, possibly while additional moistening liquid is being sprayed upwardly towards the bunch and is distributed over the leaves.

Thus, according to this method the quantity of water necessary for moistening is in principle applied by just dipping the butt end of the bunch into the water but, if necessary, later on during the process additional liquid may be applied by spraying on to the bunch in a way known per se. By varying the depth and time of immersion, the quantity of water absorbed may be controlled within rather narrow limits and, after the bunch has been turned into its suspended position, the effect of gravity as well as the fask shaking will cause water to be well distributed to all leaf surfaces. The shaking has the additional effect that the leaves move relatively to each other, and especially, are mutually reciprocated while contacting one another. This has proved to highly enhance the absorption of the water in the leaves, as the water is being rubbed and massaged into the leaves through the wax layer on the leaf surfaces, thereby being prevented from concentrating in larger or smaller drops or pearls on this layer. A consequence of this intensive penetration of the water into the leaves is that the subsequent intermediate storage of the tobacco for the purpose of its setting may be substantially reduced, e.g. from approximately 24 hours down to just two hours, whereupon the leaves after once more having been subjected to mechanical shaking up, possibly in connection with a final adjustment of their humidty, can be delivered for further processing in orderly bundles or stacks. Thus, the method according to the invention provides for a radical reduction of the time required for the moisture conditioning, and in practice it may be carried out as a continuous process which only requires a minimum of manual handling and, at the same time, is highly flexible with respect to the quantity of water absorbed in the bunch as well as to the intensity and duration of the shaking for the purpose of distributing and working in of this quantity of water, thus rendering optimum possibilities for achieving a desired tobacco humidty.

According to the invention, the shaking is advantageously effected by angular oscillation of the bunch about an axis that is substantially parallel to the main plane of the bunch. With such orientations of the axis, the inertia of the leaves will cause suitable minor displacements between the leaves with the previously explained effect.

While being subjected to shaking, the bunch may advantageously be suspended between a pair of panels which are parallel to the bunch main plane and limit the possibility of the tobacco leaves to flaring outwardly and upwardly. This is of special advantage if during its shaking the bunch is subjected to an upwardly directed, preferably pulsating, air flow. By applying such air flow, the distribution of the liquid on the leaves can be improved and the relative movements of the leaves can be intensified, but at the same time there is an increased risk for the tobacco leaves to be disarranged in the bunch. This risk is avoided by using the panels which do permit the leaves in the bunch to spread to a certain degree, i.e. they allow the thickness of a bunch to be increased, but they prevent a too extensive flaring-out or folding-up of the leaves, especially of the outer leaves of the bunch.

The invention also relates to an apparatus for carrying out the explained method and comprising a plurality of tobacco bunch holding means which are incorporated in a conveyor and are movable through a bunch hanging section, a dipping section, and a shaking section. According to the invention, this apparatus is characterized in that each of the holding means comprises a gripper for pinching the neck portion of the bunch, said gripper besides being movable through said sections, being also pivotable approximately 180° on a horizontal axis between a first position held in the hanging and shaking sections, and a second position held in the dipping section, and being furthermore reciprocable, substantially in the direction of its pivoting axis, in the shaking section.

As has been mentioned previously, the bunches will normally have been pretreated with hot steam so that the individual leaves will be rather soft and flexible when ready for being mounted in the holding means. This is the reason why the leaves should point downwardly when being mounted in order not to become disarranged. For the same reason, the tip ends of the leaves should also point downwardly while the bunch is being shaked, whereas they must point upwardly during the application of the liquid by immersion, since liquid applied by immersion of the tip ends of the leaves would not be distributed over the entire leaf area in the desired way. The reciprocating movement of the holding means while in the shaking section contributes to the distribution and also promotes the penetration of the liquid into the leaves, as previously explained.

Several expedient features of the apparatus according to the invention will be more fully explained in the following description with reference to the drawing, but it should be mentioned already now that further to the bunch hanging, dipping, and shaking sections and an intermediate storage conveyor, the apparatus may advantageously comprise an additional conveyor with oscillatory holding means which are also movable through a hanging section, a shaking section and a bunch release section. The intermediate storage conveyor may comprise an endless conveyor belt on which the bunches can be moved through a temperature and humidity controlled chamber during the desired intermediate storage period, and the capacity of which equals the capacity of the other sections of the apparatus so that the whole process may be carried out continuously and with a minimum of manual operations.

DETAILED DESCRIPTION OF THE PREFERRED EMBODIMENT

Figure 1:
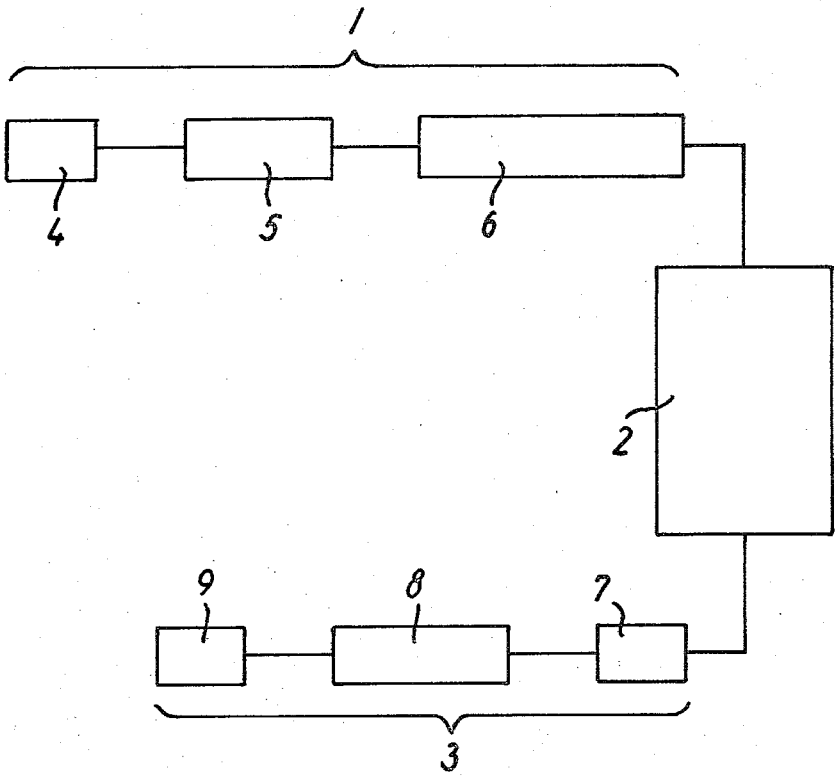
FIG. 1 shows a block diagram of an embodiment of the apparatus according to the invention.

The apparatus illustrated in FIG. 1 comprises three conveyors, viz. a dipping and shaking conveyor 1, an intermediate storage conveyor 2, and a final treatment conveyor 3. In the embodiment shown, these conveyors may be considered as independent units but, if desired, they may also be integrated and to virtually constitute a single conveyor which enables complete moisture conditioning of the tobacco in a continous movement and without manual operations.

The first conveyor 1 comprises three main sections, viz. a hanging section 4, a dipping section 5, and a shaking section 6, and the conveyor 3 includes in a similar way a hanging section 7, a shaking section 8, and a bunch release section 9. In the following, each of these conveyors is supposed to consist of a rotary support carrying a number of holding means for the tobacco bunches, but they might as well consist of e.g. endless conveyor chains carrying corresponding holding means.

Figure 2:
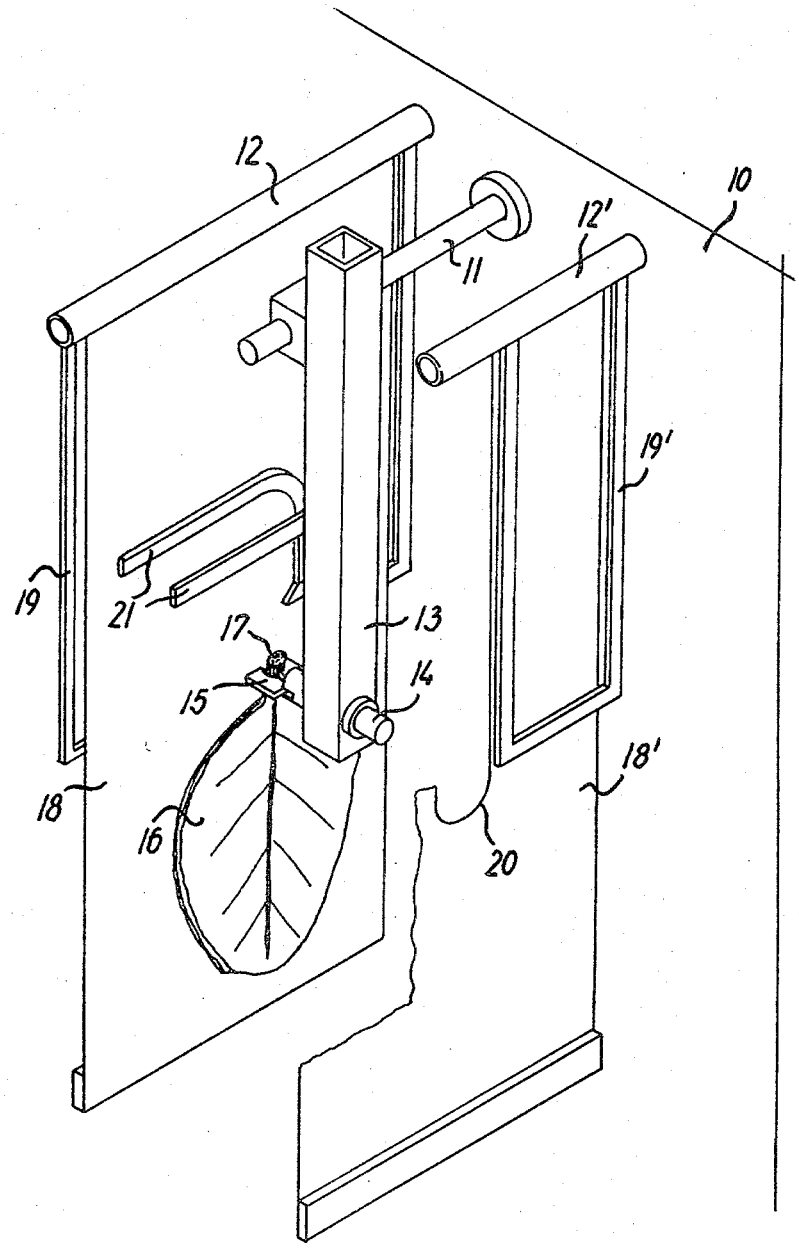
FIG. 2 a perspective view, with certain parts broken away, of a holding means incorporated in a first conveyor and holding a newly suspended tobacco bunch.
Figure 3:
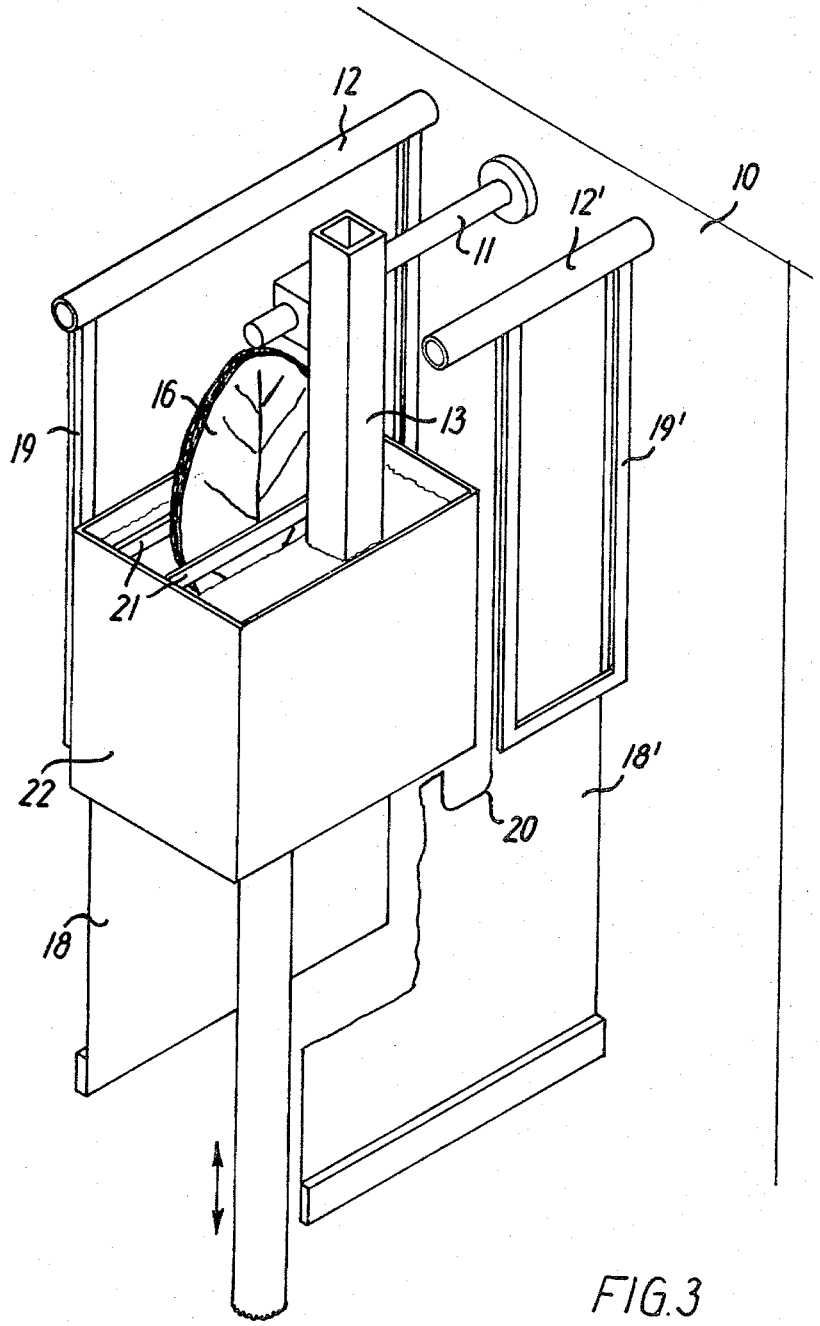
FIGS. 3 and 4 similar views of the holding means with the tobacco bunch in the dipping and shaking sections, respectively.
Figure 4:
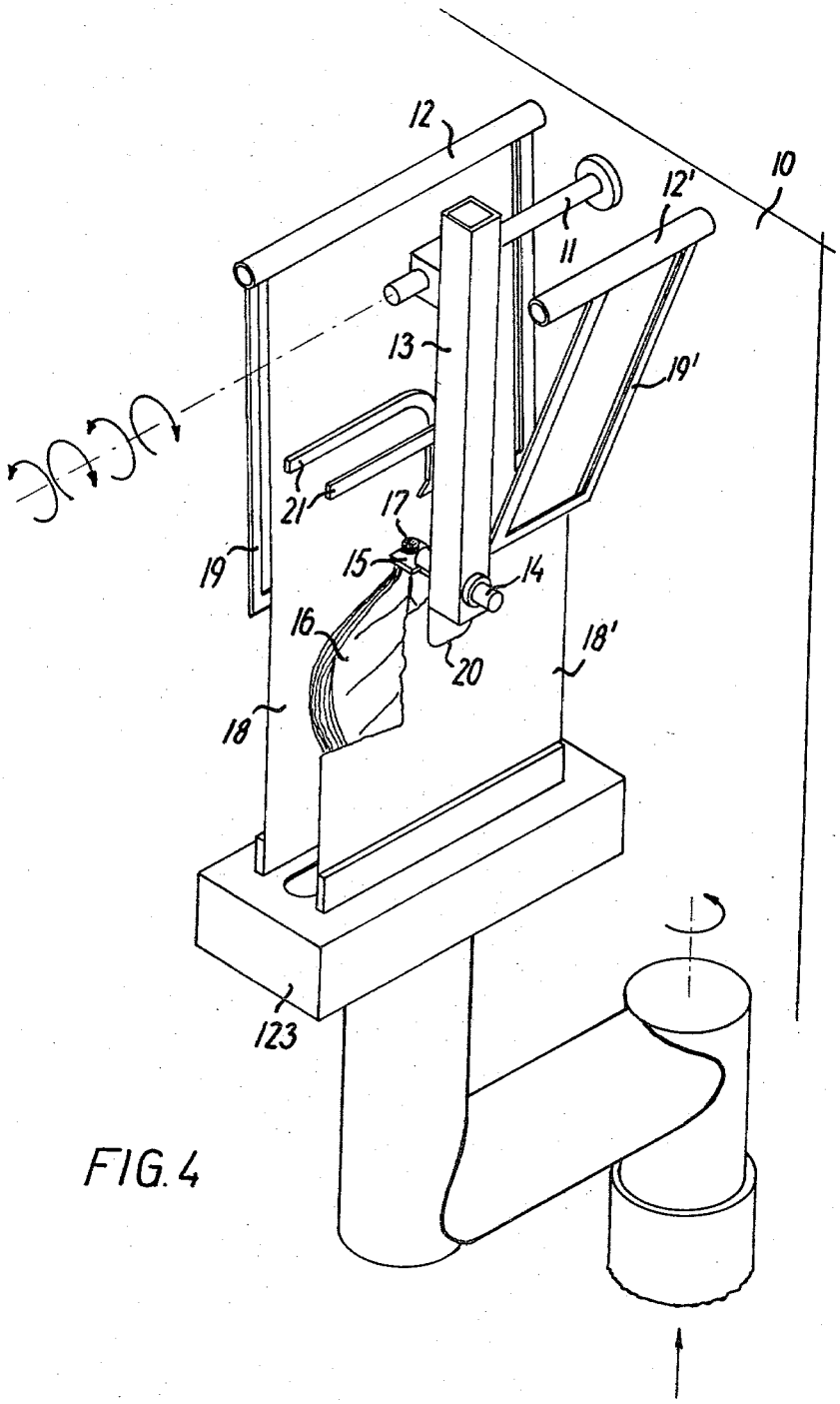

In FIGS. 2, 3, and 4, the rotary support of the conveyor 1 is indicated by 10. This support carries a plurality of equidistant, radially extending shafts 11 for the holding means, only one such shaft being shown. Each shaft is placed between two additional radial shafts 12 and 12' later to be described more fully. By means of a driving mechanism which per se can be of conventional kind and therefore is not shown in the drawing, the shaft 11 can be oscillated at a frequency of approximately 500 strokes per minute and with an amplitude of a few angular degrees, for instance approximately 5°.

The shaft 11 is firmly connected to a substantially vertical rod shaped carrier formed by a tube 13, in the lower end of which a short shaft 14 is pivoted so as to be perpendicular to the shaft 11. A pinch-like gripper 15 for temporarily holding a tobacco bunch 16 by its neck or butt end 17 is connected to the shaft 14. The shaft 14 is pivotable through approximately 180°, and a mechanism from which the shaft receives its motion may be housed in the shaft 11 and the tube 13. The gripper 15 is supposed to be operated manually but, if desired, it may be opened and closed mechanically.

The shafts 12 and 12' carry suspended flexible panels 18 and 18' having supporting frame 19 and 19', respectively. The shaft 12 may be stationary and it may be so positioned that the associated panel 18 has only a small distance from the gripper 15, whereas the shaft 12' is movable between a position, FIGS. 2 and 3, in which its panel 18' is vertical and has a relatively large distance from the panel 18, and a position, FIG. 4, in which its lower section has been swung as to approach the panel 18. In order to make this possible, the panel 18' has an opening 20 for the rod shaped carrier 13.

In FIG. 2 a tobacco bunch 16 has just been hung in the gripper 15 in such a position that its main plane is parallel to the panels 18 and 18' and thus also parallel to the shaft 11. With a view to the immersion to follow, the bunch has to be turned so that its butt end 17 points downwardly. This is achieved by the previously mentioned turning of the shaft 14, and for supporting of the bunch in its new position the carrier 13 is provided with a stationary fork 21, the prongs of which are substantially horizontal and point away from the support 10 so as to automatically catch the tobacco leaves during the final part of the turning movement.

Hereafter, immersion is carried out by lifting a vessel 22 for the moistening liquid, FIG. 3, upwardly between the vertical panels 18 and 18' into a position in which a suitable portion of the tobacco bunch is immersed below the liquid level. After expiration of the desired immersion time, the vessel 22 will again be lowered whereupon the tobacco bunch 16 will be turned back into its suspended position. Simultaneously, the shaft 12' with the supporting frame 19' will be swung inwardly into the position shown in FIG. 4, thereby causing the lower part of the panel 18' to approach the tobacco bunch 16 for the purpose of limiting, together with wall panel 18, the possible movement of the tobacco leaves, as has been previously explained.

Hereafter, the shaking of the bunch is effected by oscillating the shaft 11 in one or more periods. During the shaking, or between the shaking periods, air may be blown, possibly in a pulsating flow, upwardly towards the bunch from an outlet 123 which, as indicated in FIG. 4, can be lifted upwardly towards the bunch and be swung underneath the bunch. The effects of the shaking and of the air flow have been explained previously.

Figure 5:
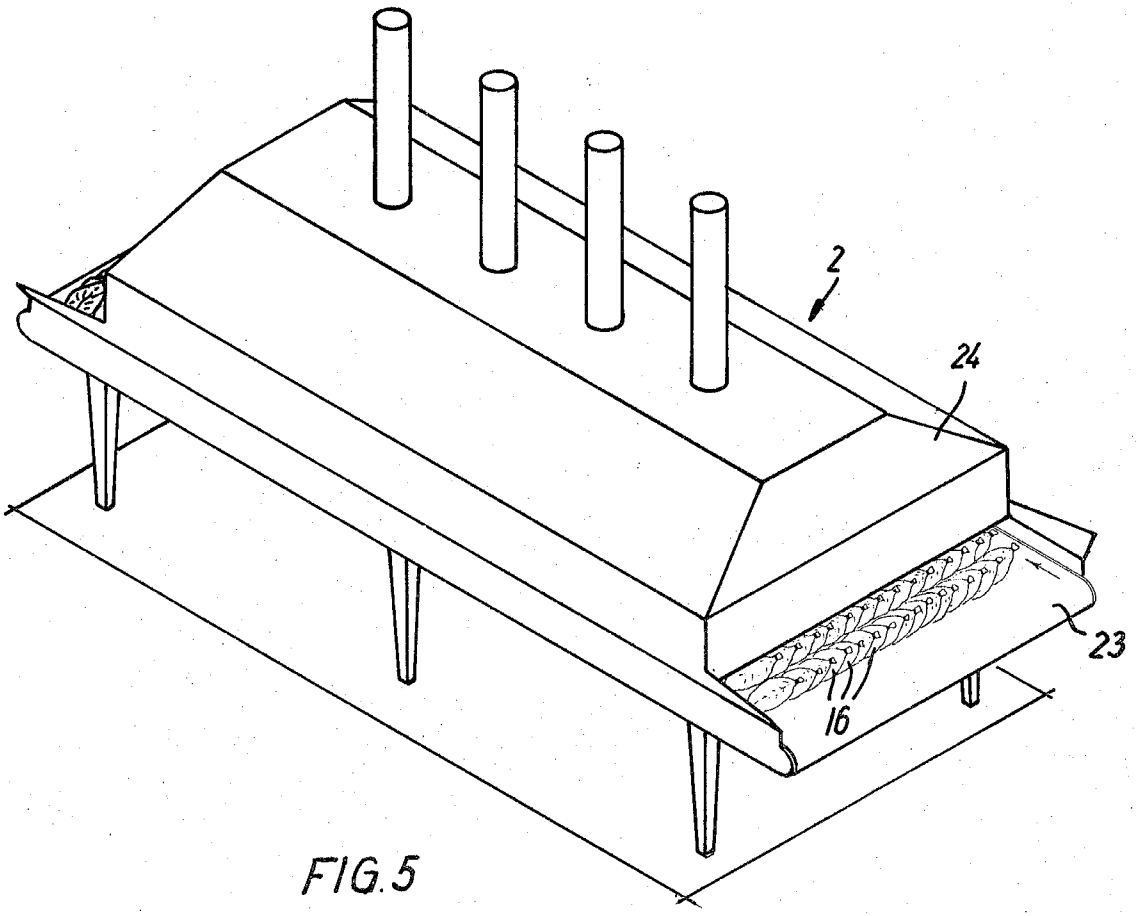
FIG. 5 an intermediate storage conveyor.

Thereafter, the tobacco must be given possibility for setting in a suitable period, for instance two hours, and for this purpose, the moistened tobacco bunches 16 are released from the holding means 13, 14, 15 and are placed on a slowly advancing belt 23 which is part of the intermediate storage conveyor 2, as shown i FIG. 5. The belt passes through a casing 24 within which the temperature and the air humidity as well as the belt advancing speed can be controlled in a well known manner.

Figure 6:
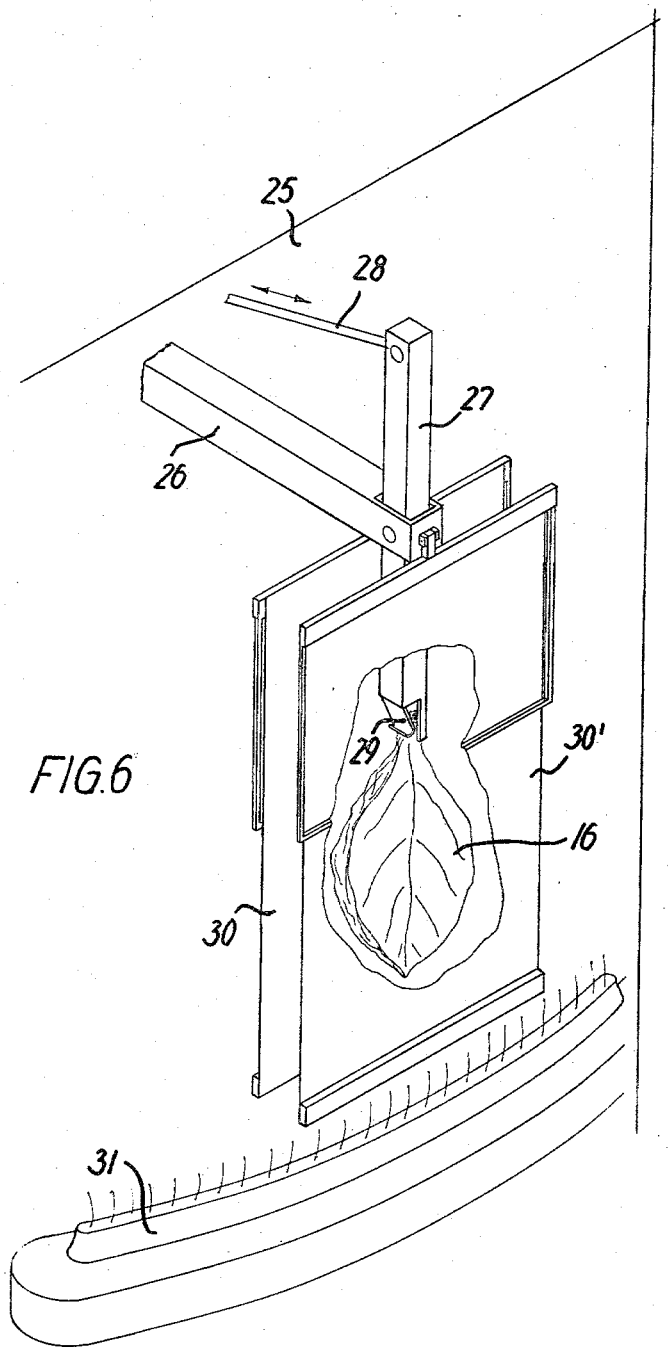
FIG. 6 a perspective view, with certain parts broken away, of a holding means incorporated in an additional conveyor and with a suspended tobacco bunch during the final shaking.
Figure 7:
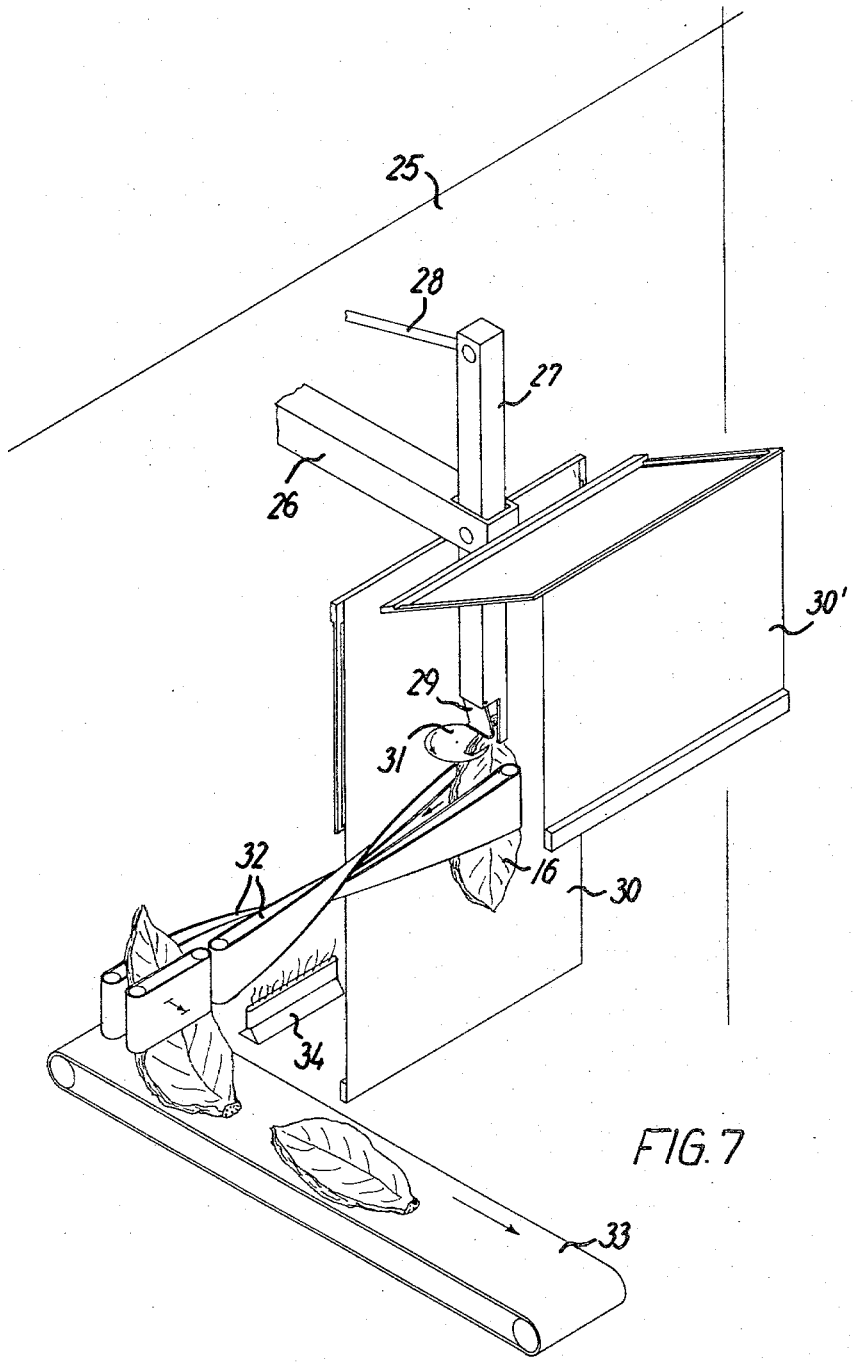
FIG. 7 the bunch release section of this additional conveyor.

From the intermediate storage conveyor 2, the tobacco bunches 16 are transferred to the conveyor 3 which may also have a rotary support 25, FIGS. 6 and 7, with an annular series of holding means, each of which in this case comprises a radially extending arm 26 carrying a substantially vertical carrier 27 at its outer end, said carrier 27 at its upper end being coupled to a connecting rod 28 and carrying at its lower end a gripper 29 for seizing the neck or butt end 17 of the bunch 16. Intermediate these ends the carrier is hinged to the arm 26. In this case, the bunch 16 is suspended in such a way that its main plane is perpendicular to the arm 26, and so is also a pair of flexible panels 30 and 30' associated with the arm. The radially outer panel 30' can be swung outwardly, FIG. 7, in order to give access to the gripper 29.

During its rotational movement, the holding means 26, 27, 28, 29 pass one or more sets of nozzles 31 for blowing possibly humidified compressed air upwardly towards the bunch 16 for the purpose of final humidity adjustment and, thereafter, the holding means pass through the release section 9, FIG. 7, in which a disc knife 31 is provided for cutting through the bunch near its firmly held neck portion. At this time, the tobacco leaves of the bunch are held between two crossed, endless belts 32 which transfer the tobacco leaves in orderly bundles of substantially smooth individual leaves to a belt conveyor 33. Underneath the crossed belts 32 a set of nozzles 34 may be provided for delivering an air flow which, if required, can dry the butt ends and can further shake loose the tobacco leaves in the bundles, thus making it easier to pick up the leaves one by one, for instance directly from the belt conveyor 33.

What is claimed is:

1. A method for moisture conditioning of tobacco leaves in substantially flat bunches, while maintaining the leaves in substantially the same shape and with the same relative position as in the untreated tobacco bunch, said method comprising:

partially immersing a bunch into a moistening liquid while holding the bunch in a substantially vertical position with its neck pointing downwardly turning the bunch so that the neck points upwardly and subsequently mechanically shaking the bunch while holding it by its neck portion and limiting the movement of the leaves in relation to each other; and shaking the bunch a second time after setting.

2. The method of claim 1, including spraying additional moistening liquid on the bunch during or prior to said second shaking.

3. The method of claim 2, in which the shaking is affected by angular oscillation of the bunch about an axis substantially parallel to the main plane of the bunch.

4. The method of claims 1 or 3, in which the shaking is at a frequency of about 500 strokes per minute.

5. The method of claim 1, including limiting the outward flare of the leaves of the bunch by suspending the bunch between a pair of panels generally parallel to the main plane of the bunch.

6. The method of claims 1 or 5, including subjecting the bunch to an upwardly directed, preferably pulsating air flow during shaking.

7. Apparatus for moisture conditioning of bunches of tobacco leaves which in each bunch is held together at its stem end to form a neck portion of the bunch, said apparatus comprising:

a conveyor means having a bunch hanging section, a bunch neck section dipping section and a bunch shaking section;

a plurality of bunch holding means mounted for movement through said conveyor means sections, the holding means including a bunch neck portion gripper on a generally horizontal shaft, said shaft being mounted for pivotal movement of approximately 180° about its longitudinal axis between a first position in which the neck portion of a gripped bunch points upwardly and a second position in which said neck portion points downwardly;

means to pivot said holding means to said first position in said hanging and shaking sections and to said second position in said dipping section;

means to rapidly reciprocate said gripper shaft substantially parallel to its axis when in said shaking section.

8. The apparatus of claim 7, in which the gripper shaft is journalled at the lower end of a generally vertical rod element forming part of the holding means and having its upper end connected to a horizontal oscillatory shaft carried by the conveyor and extending substantially perpendicular to said gripper shaft.

9. Apparatus according to claim 8 in which a stationary fork is provided on the rod shaped carrier above the gripper, the prongs of said fork being substantially horizontal and perpendicular to the swing axis of the gripper.

10. Apparatus according to claim 8 in which in the dipping section a vessel for moistening liquid is provided which, from an inoperative lower position, can be raised into a position in which the lower portion of the carrier including the gripper is immersed into said vessel.

11. The apparatus of claim 7, in which a pair of parallel vertical panels are carried by the conveyor on either side of the horizontal oscillatory shaft, said panels extending downwardly past the gripper and being sufficiently closely spaced to restrict the possibility of the tobacco leaves flaring outwardly and upwardly in the shaking section.

12. The apparatus of claim 11, in which at least one of said panels incorporates a frame which is swingable about an upper pivot axis between a substantially vertical position and an inclined position with increased distance from the other panel.

13. The apparatus of claim 11, in which the shaking section includes means directing an air flow upwardly towards the gripper.

14. Apparatus according to claim 11 in which at least the lower sections of said panels are mutually movable between a relatively open position held in the suspending and dipping sections, and a relatively closed position held in the shaking section.

15. The apparatus of claim 7, including an intermediate storage conveyor and an additional conveyor having oscillatory holding means that are also moveable through a hanging section, a shaking section and a bunch release section.

16. Apparatus according to claim 15 in which, in connection with the additional conveyor, means are provided for applying an air flow upwardly towards the holding means.

17. Apparatus according to claim 15 in which the bunch release section includes a belt conveyor for seizing the tobacco leaves of the bunch, and a knife for subsequently cutting free the leaves from the neck of the bunch held by the holding means.

* * * * *